US007053876B2

(12) United States Patent
Kimura et al.

(10) Patent No.: US 7,053,876 B2
(45) Date of Patent: May 30, 2006

(54) FLAT PANEL DISPLAY DEVICE HAVING DIGITAL MEMORY PROVIDED IN EACH PIXEL

(75) Inventors: Hiroyuki Kimura, Fukaya (JP); Takanori Tsunashima, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 473 days.

(21) Appl. No.: 10/608,027

(22) Filed: Jun. 30, 2003

(65) Prior Publication Data

US 2004/0008171 A1 Jan. 15, 2004

(30) Foreign Application Priority Data

Jul. 9, 2002 (JP) ..... 2002-200129

(51) Int. Cl.
*G09G 3/36* (2006.01)

(52) U.S. Cl. ..... 345/98; 345/90; 345/204

(58) Field of Classification Search ..... 345/87, 345/90–100, 204, 211–214, 530–532
See application file for complete search history.

(56) References Cited

U.S. PATENT DOCUMENTS 5,712,652 A * 1/1998 Sato et al. ..... 345/90
6,771,247 B1 * 8/2004 Sato et al. ..... 345/98
6,778,162 B1 * 8/2004 Kimura et al. ..... 345/90
6,784,878 B1 * 8/2004 Hanari et al. ..... 345/204
6,940,483 B1 * 9/2005 Maeda et al. ..... 345/98
2002/0011998 A1 * 1/2002 Tamura ..... 345/204
2003/0030607 A1 * 2/2003 Kitagawa et al. ..... 345/87

FOREIGN PATENT DOCUMENTS

JP 2001-264814 9/2001

* cited by examiner

*Primary Examiner*—Henry N. Tran
(74) *Attorney, Agent, or Firm*—Oblon, Spivak, McClelland, Maier & Neustadt, P.C.

(57) ABSTRACT

In a flat panel display device configured to allow moving image data supplied through a signal line 11 to be written to a pixel electrode 13 during typical display operation and further to allow still image data latched in a digital memory 18 to be written to the pixel electrode 13 during still image display operation. When switching from a typical display to a still image display, at least two frames following the completion of the switching operation are assigned as write frames to allow still image data to be written to the digital memory 18. This allows the still image data to be written normally to the digital memory 18 even when the rise times of a memory control signal and a common signal are made longer than a vertical blanking period.

4 Claims, 3 Drawing Sheets

FLAT PANEL DISPLAY DEVICE HAVING DIGITAL MEMORY PROVIDED IN EACH PIXEL

CROSS-REFERENCE TO RELATED APPLICATIONS

This application is based upon and claims the benefit of priority from Japanese Patent Application No. 2002-200129 filed Jul. 9, 2002; the entire contents of which are incorporated herein by reference.

BACKGROUND OF THE INVENTION

1. Field of the Invention

The present invention relates to a flat panel display device having a digital memory provided in each pixel and a method for driving the same.

2. Description of Related Art

In recent years, a liquid crystal display device has been widely and increasingly adopted in the field of compact information terminals such as a portable telephone and an electronic book, because it advantageously is light, thin and consumes low power. Such compact information terminals are typically driven by a battery and therefore, it strongly requires a configuration that consumes low power.

Particularly, a portable telephone needs to have the ability to perform display functions while consuming lower power. To achieve such a portable telephone, a technique is disclosed, for example, in Japanese Patent Application Laid-open No. 2001-264814. The publication discloses a liquid crystal display device including a digital memory provided in each pixel, in which when a still image is displayed, still image data stored in a digital memory is used to display the image and while operating only an alternate drive circuit for alternately driving a liquid crystal and stopping the operation of other peripheral drive circuits. According to the technique, only an alternate drive circuit operates during still image display period and therefore, the liquid crystal display device is able to operate consuming lower power.

The aforementioned liquid crystal display device is considered to operate such that when the alternate drive circuit is made to operate, the rise time of a memory control signal used to control a switching element for retrieving data representing a still image from a digital memory and the rise time of a common signal supplied to a common electrode are each made long, reducing electrical power consumed by a signal generation circuit for generating a memory control signal and a common signal.

However, the rise time of a memory control signal or a common signal needs to be kept within a vertical blanking period during which a typical halftone display or a typical moving image display (hereinafter, referred to as a typical display) is switched to a still image display. This is because if the rise time of a memory control signal or a common signal becomes longer than a vertical blanking period, an erroneous write operation occurs while still image data is written to a digital memory. As noted above, the rise time of a memory control signal or a common signal is not allowed to become longer than the vertical blanking period, and the problematic nature of present day technique occurs, in particular when a display device further reduces power consumption during still image display operation.

To avoid the above-mentioned problem, a configuration for making a vertical blanking period longer in response to lengthening the rise time of a memory control signal or a common signal may also be conceived. In this case, erroneous writing of still image data can be avoided, but the typical display period becomes short and a clock frequency at which a write operation is performed during the typical display operation becomes high, leading to an increase in power consumption. Accordingly, such a configuration cannot provide an effective solution to the aforementioned current problems.

SUMMARY OF THE INVENTION

An object of the invention is to achieve further decrease in power consumption during still image display operation without resulting in the occurrence of an erroneous write to a digital memory and an increase in power consumption during typical display operation.

A flat panel display according to the present invention is constructed as follows. First, an array substrate including: a plurality of scanning lines and a plurality of signal lines crossing each other to form a cross-wired matrix; a pixel electrode provided so as to correspond to each lattice in the matrix; a pixel switching element which allows moving image data supplied to the signal line to be written to the pixel electrode in response to a scanning signal supplied to the scanning line; a digital memory which latches still image data; and a switch circuit which inverts a polarity of still image data and retrieves the still image data from the digital memory. Second, an opposing substrate having a common electrode being disposed facing the pixel electrode. Third, a display layer held between the array substrate and the opposing substrate. Finally, a control circuit configured to allow moving image data to be written to the pixel electrode during typical display operation and at the time of switching from a typical display to a still image display, assign as write frames at least initial two frames following the completion of the switching in order to allow still image data to be written to the digital memory, and further, to allow still image data latched in the digital memory to be written to the pixel electrode during still image display operation. The device is further constructed such that at least one of the rise times of a memory control signal supplied to the switch circuit and a common signal supplied to the common electrode is made longer than a vertical blanking period immediately following the completion of the typical display.

According to the invention, the flat panel display device is constructed such that when a typical display is switched to a still image display, the initial two frames following the completion of the switching operation are assigned as write frames so as to allow still image data to be written to the digital memory. Therefore, even when the still image data has not been sufficiently written to the digital memory during the first frame, the same still image data is written to the digital memory during the second frame, allowing the still image data to be written to the digital memory without encountering an error. This permits the flat panel display device to make the rise time of a memory control signal or a common signal longer than a vertical blanking period, achieving a decrease in power consumption during still image display operation.

In a preferred embodiment of a flat panel display device, making both rise and fall times required, respectively, for a memory control signal and a common signal to rise and fall longer than a vertical blanking period allows for a further decrease in power consumption.

Moreover, supplying a memory control signal and a common signal whose rise times are made longer than a vertical blanking period, immediately after the beginning of the vertical blanking period, allows the still image data to be more securely written to the digital memory.

A method for driving a second flat panel display device according to the present invention will be described later. Here, the flat panel display device is constituted as follows. First, an array substrate including: a pixel electrode provided so as to correspond to each lattice in a cross-wired matrix formed by crossing a plurality of scanning lines and a plurality of signal lines each other; a pixel switching element which allows moving image data supplied to the signal line to be written to the pixel electrode in response to a scanning signal supplied to the scanning line; a digital memory which latches still image data; and a switch circuit which inverts a polarity of still image data and retrieves the still image data from the digital memory. Second, an opposing substrate having a common electrode being disposed facing the pixel electrode. Finally, a display layer held between the array substrate and the opposing substrate. The method for driving the flat panel display device, includes: writing moving image data to the pixel electrode during typical display operation; assigning as write frames at least initial two frames following the completion of switching from a typical display to a still image display, in order to allow still image data to be written to the digital memory; writing still image data latched in the digital memory to the pixel electrode during still image display operation; and making at least one of the rise times of a memory control signal supplied to the switch circuit and a common signal supplied to the common electrode longer than a vertical blanking period immediately following the completion of typical display.

DETAILED DESCRIPTION OF EMBODIMENT

An embodiment of an active matrix liquid crystal display device constructed in accordance with the invention will be explained below. In the embodiment described below, video data used to provide a halftone display or a moving image display during typical display operation is referred to as moving image data. Furthermore, video data used to provide a black display or a white display during still image display operation is referred to as still image data.

Figure 1:
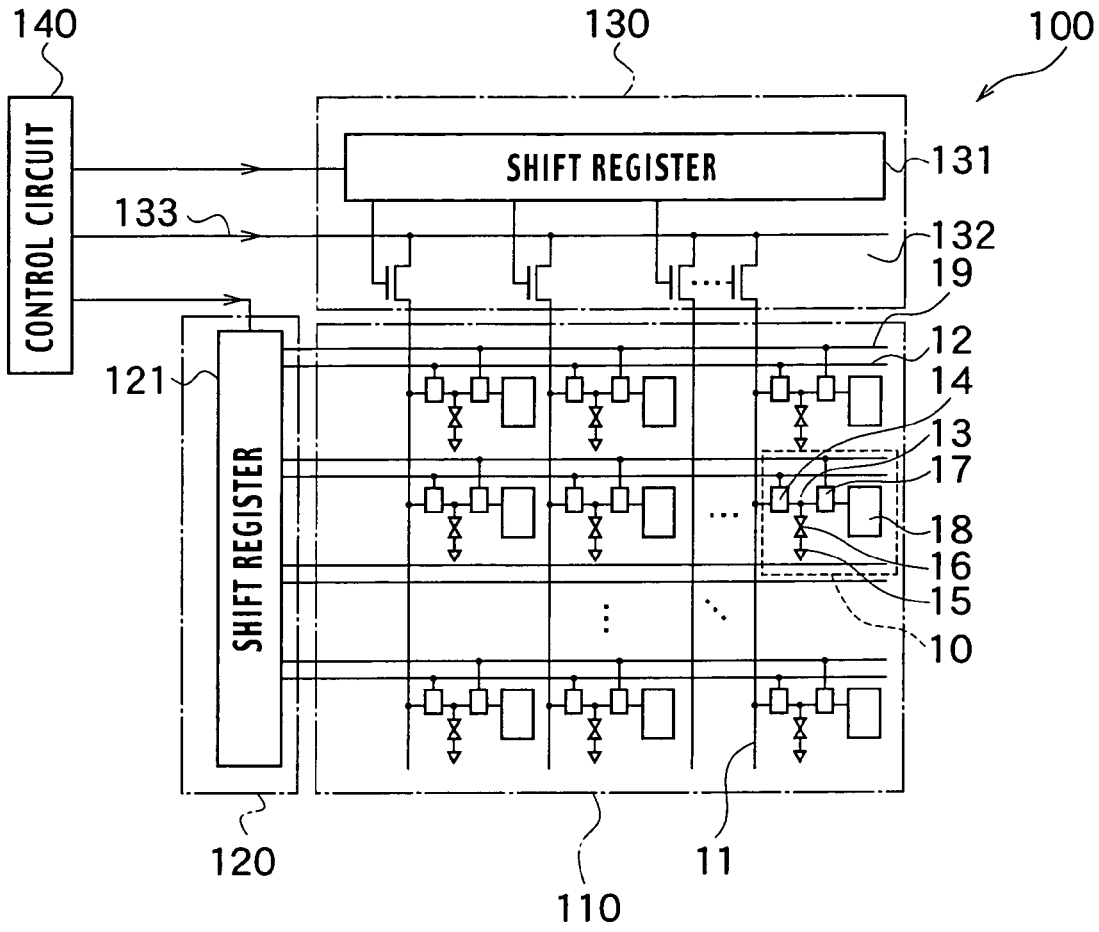
FIG. 1 is a circuit diagram illustrating the configuration of a flat panel display device of the embodiment.

As shown in a circuit diagram of FIG. 1, a liquid crystal display device 100 includes a display section 110 having a plurality of pixels 10 formed therein, a scanning line drive circuit 120, a signal line drive circuit 130, and a control circuit 140.

Figure 2:
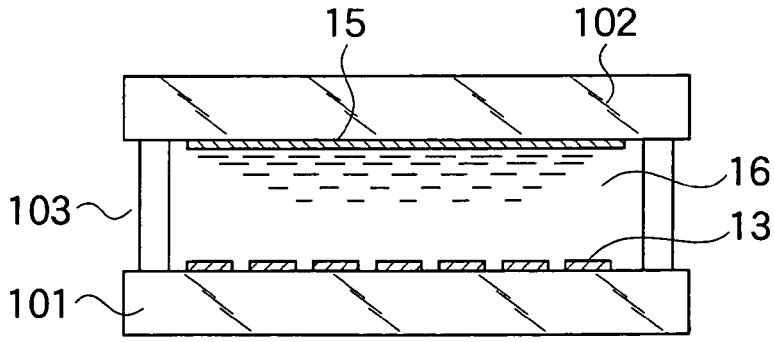
FIG. 2 is a diagram illustrating the configuration of a cross section of the flat panel display device shown in FIG. 1.

The display section 110, the scanning line drive circuit 120 and the signal line drive circuit 130 are integrally fabricated on an array substrate 101 shown in FIG. 2. Alternatively, the scanning line drive circuit 120 and the signal line drive circuit 130 may be disposed on an external circuit board not shown herein.

In the display section 110, a plurality of signal lines 11 and a plurality of scanning lines 12 form a cross-wired matrix, and the pixel 10 is provided so as to correspond to each lattice in the matrix.

The pixel 10 includes a pixel electrode 13, a pixel-switching element 14, a common electrode 15, a liquid crystal layer 16, a switch circuit 17, and a digital memory 18. The pixel-switching element 14 is formed of a CMOS transistor.

The pixel-switching element 14 has a source connected to the signal line 11, a gate connected to the scanning line 12, and a drain connected to the pixel electrode 13. The pixel electrode 13 is connected to the digital memory 18 via the switch circuit 17. Connected to the switch circuit 17 is a memory control signal line 19 used to control internal switching elements. Note that an auxiliary capacitor not shown herein is electrically connected in parallel with the pixel electrode 13. Furthermore, although the memory control signal line 19 forms two wiring lines that are provided so as to correspond to each scanning line and disposed parallel thereto, the two wiring lines are denoted as a single line in FIG. 1 for simplification of explanation.

As illustrated in the cross sectional view shown in FIG. 2, the common electrode 15 is formed on an opposing substrate 102 so as to face the pixel electrode 13 on the array substrate 101. The liquid crystal layer 16 is held as a display layer between the pixel electrode 13 and the common electrode 15. A signal generation circuit (not shown), which operates in accordance with instruction from the control circuit 140, supplies a common signal having a specific voltage potential to the common electrode 15 in response to a display mode. A peripheral gap between the array substrate 101 and the opposing substrate 102 is sealed with a sealant 103. Note that in FIG. 2, components such as an alignment film and a polarization plate are not shown for purpose of simplification.

In the embodiment, moving image data is written using an H line alternate drive scheme. For this reason, the control circuit 140 operates such that during typical display operation, the common signal is made to have its polarity inverted every horizontal scanning period so that the inverted polarity becomes opposite the polarity of moving image data. During still image display operation, the common signal is made to have its polarity inverted within a frame period so that the inverted polarity becomes opposite the polarity of still image data. During still image display operation, the rise time (and fall time) of the common signal is made longer than the vertical blanking period for the purpose of reducing power consumption. In more detail, the rise time is determined by increasing output impedance that the signal generation circuit exhibits when outputting the common signal, while reducing the current necessary for the outputting.

The scanning line drive circuit 120 includes a shift register 121 and a buffer circuit, not shown. The scanning line drive circuit 120 outputs a scanning signal to each scanning line 12 every horizontal scanning period based on a vertical clock signal and a vertical start signal supplied as a control signal from the control circuit 140. The scanning signal causes the potential of the scanning line 12 to become high level, turning the entire pixel switching elements 14 connected to the scanning line 12 to an on state (conduction state).

During typical display operation, the scanning line drive circuit 120 operates to cause the potential of each scanning line 12 to become high level by supplying a scanning signal to the corresponding scanning line, and during still image display operation, it operates to cause the potentials of all of the scanning lines 12 to become low level.

The control circuit 140 supplies a memory control signal of a high or low level to the memory control signal line 19 via the signal generation circuit, not shown herein, in response to a display mode to control the on/off states of the switch circuit 17. During typical display operation, the control circuit 140 operates to cause the potential of the memory control signal line 19 to become a low level, and during still image display operation, it operates to cause the potential of the memory control signal line 19 to become alternately inverted with a frame period. In this case, for the purpose of reduction in power consumption, the control circuit 140 is operable to make the rise time (and fall time) of a memory control signal longer than the vertical blanking period. In more detail, the rise time is determined by increasing output impedance that the signal generation circuit exhibits when outputting the memory control signal, while reducing the current for the outputting.

It is obvious that, even making only one of the rise times of the memory control signal and the common signal longer than the vertical blanking period allows a reduction in power consumption.

The signal line drive circuit 130 includes a shift register 131 and an analog switch 132. The signal line drive circuit 130 receives a horizontal clock signal and a horizontal start signal as a control signal from the control circuit 140, and further, receives video data from the control circuit 140 via a video bus 133. The signal line drive circuit 130 supplies an on/off signal to the analog switch 132 through the shift register 131 based on those control signals in order to sample the video data supplied via the video bus 133, and then outputs the sampled video data to the signal lines 11.

The operation of the liquid crystal display device during typical display will be explained briefly. When the scanning line drive circuit 120 outputs a scanning signal in order to cause the voltage potential of each of the scanning lines 12 to become high level in descending order from top to bottom every horizontal scanning period, all of the pixel switching elements 14 connected to the scanning line 12 becoming high level are turned on. When the signal line drive circuit 130 samples the moving image data and outputs the sampled moving image data to the signal lines 11 in synchronization with the turning on of the corresponding scanning line 12, the moving image data is written to the pixel electrodes 13 via the corresponding switching elements 14. The moving image data is charged as a write voltage between the pixel electrode 13 and the common electrode 15 (and further across an auxiliary capacitance though not shown), and the liquid crystal layer 16 responds in proportion to the magnitude of the write voltage in order to control the amount of light transmitting from each of the pixels 10. Performing the aforementioned write operations on all of the scanning lines 12 within a frame period establishes a complete video image corresponding to one screen.

Figure 3:
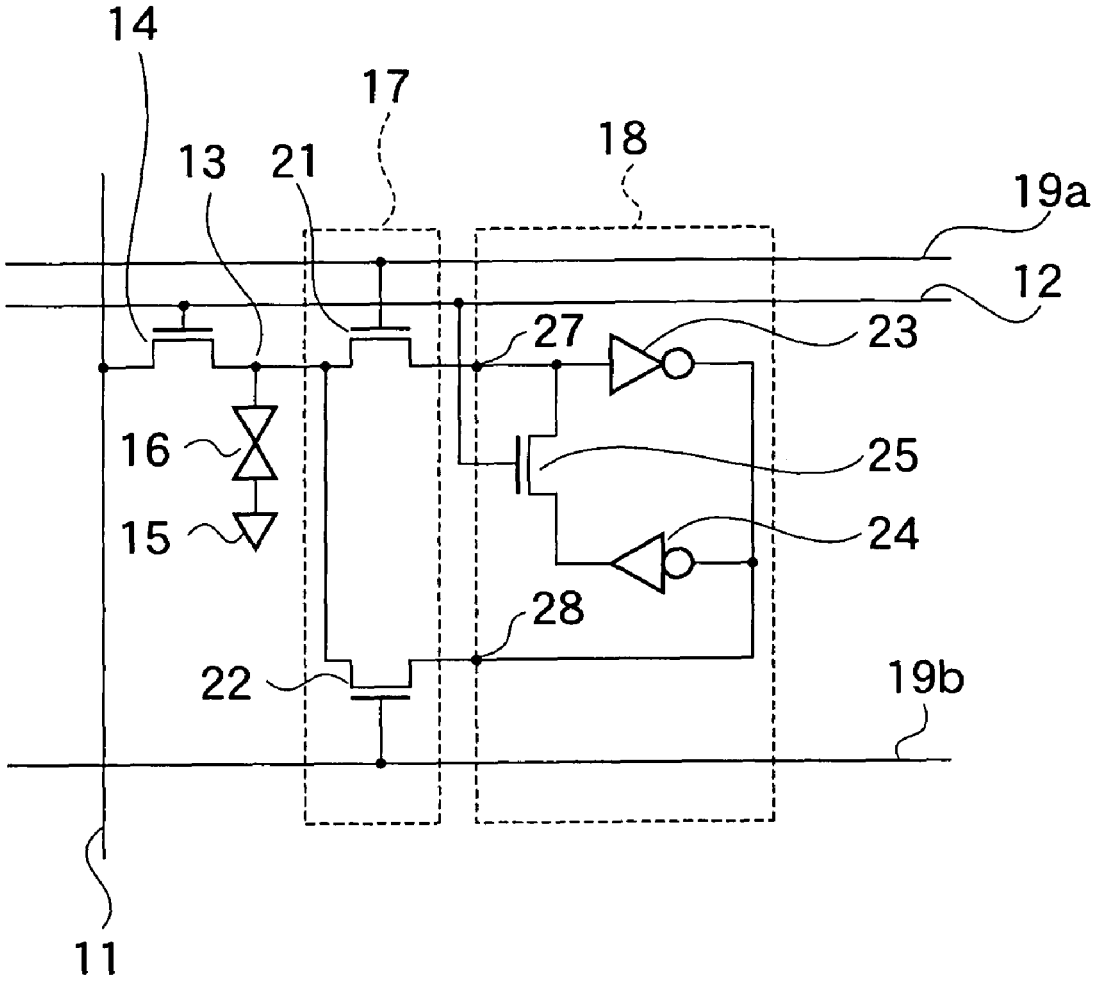
FIG. 3 is a diagram illustrating the configuration of a pixel of the flat panel display device shown in FIG. 1.

Next, the construction of the circuit within the pixel 10 will be explained in detail. Referring to a circuit diagram shown in FIG. 3, the switch circuit 17 is inserted between the digital memory 18 (an output terminal 27 and an inverted output terminal 28 thereof) and the pixel electrode 13. The switch circuit 17 includes two switching elements 21 and 22 formed of a CMOS transistor. The switching element 21 has a gate connected to a memory control signal line 19*a* and the switching element 22 has a gate connected to a memory control signal line 19*b*. The control circuit 140 supplies a memory control signal to each of the memory control signal lines 19*a* and 19*b* in order to independently control the switching elements 21 and 22.

The digital memory 18 includes two inverter elements 23 and 24, and a switching element 25. The switching element 25 is a CMOS transistor of the opposite channel to the pixel-switching element 14. The switching element 25 and the pixel switching element 14 each have a gate connected to the same scanning line 12 and are simultaneously turned on and off by a scanning signal. In this case, the pixel switching element 14 and the switching element 25 are turned on or off in a reversed relationship relative to each other. Specifically, when the pixel-switching element 14 is turned on, the switching element 25 is turned off, and when the pixel-switching element 14 is turned off, the switching element 25 is turned on.

A positive power supply line and a negative power supply line, both not shown herein, are connected respectively to the inverter elements 23 and 24, and a high power voltage and a low power voltage are supplied from a power supply circuit, not shown herein, via the corresponding power supply lines. When assuming that still image data represents a write voltage corresponding to a black display during a still image write frame, for example, a high power voltage is latched at the output of the inverter element 23 and a low power voltage is latched at the output of the inverter element 24. Furthermore, when assuming still image data represents a write voltage corresponding to a white display, for example, a low power voltage is latched at the output of the inverter element 23 and a high power voltage is latched at the output of the inverter element 24. Thus, a power voltage corresponding to a black display or a white display is latched as still image data into each of the pixels 10.

Figure 4:
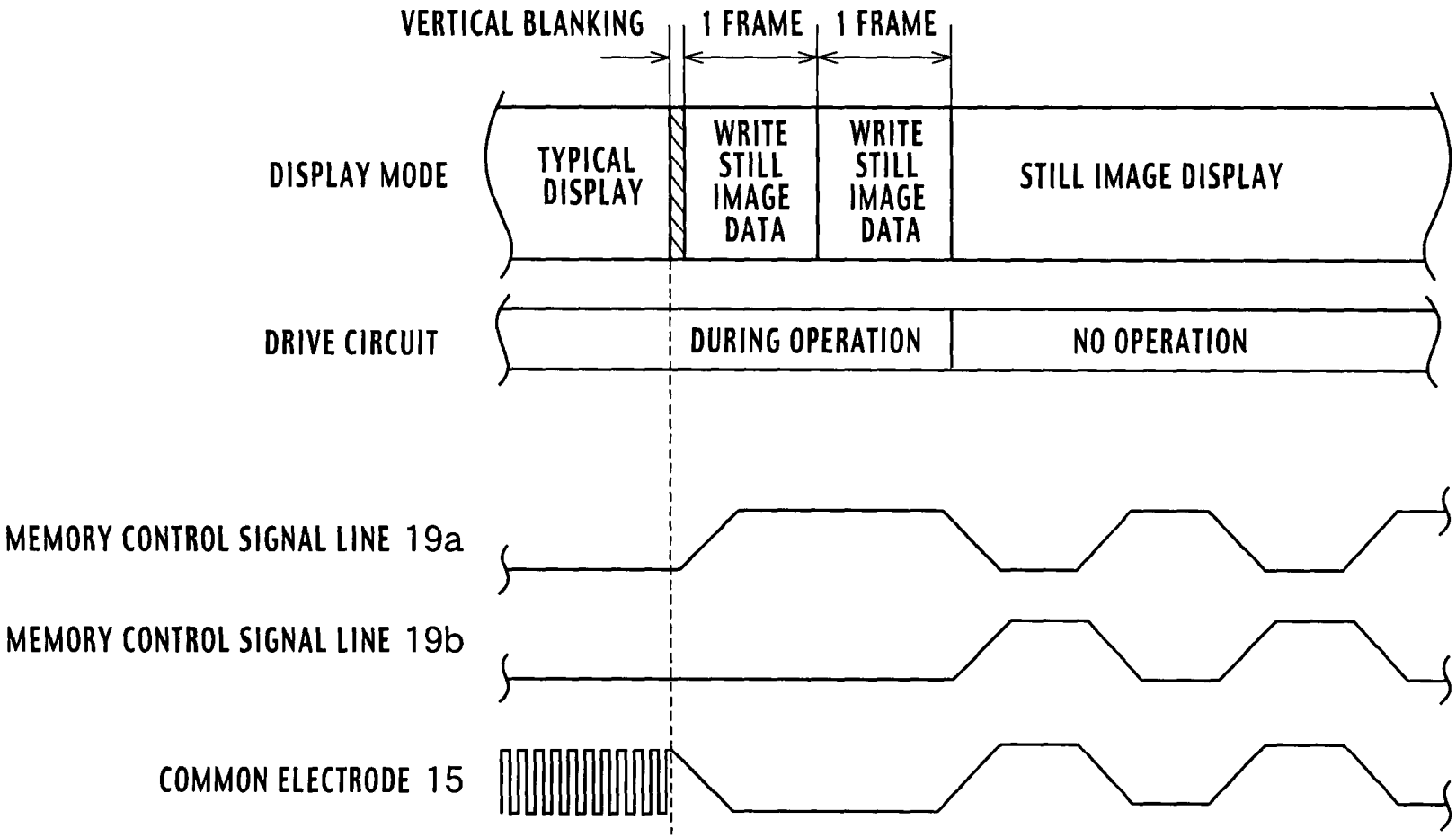
FIG. 4 is a timing chart illustrating the operation of the flat panel display device shown in FIG. 1.

Next, the operation of the liquid crystal display device 100 constructed as described above will be explained with reference to a timing chart representing the waveforms of signals and shown in FIG. 4.

During typical display operation, the control circuit 140 supplies a vertical clock signal and a vertical start signal to the scanning line drive circuit 120, and further, supplies a horizontal clock signal, a horizontal start signal and moving image data to the signal line drive circuit 130. Furthermore, the potentials of both the memory control signal lines 19*a* and 19*b* are reduced to a low level, turning the switch circuit 17 to an off state. The scanning line drive circuit 120 outputs a scanning signal in descending order from top to bottom every horizontal scanning period in order to cause the scanning lines 12 to become a high level. Then, the pixel switching element 14 is turned to an on state and moving image data supplied through the signal line 11 is written to the pixel electrode 13 via the pixel switching element 14. As noted above, during typical display operation, the liquid crystal display device generates full-color halftone and video images on the display panel. Note that when an H line alternate drive scheme is employed during typical display operation in the liquid crystal display device, the control circuit 140 is operable to alternately cause the polarity of moving image data to be inverted in an orderly manner every horizontal line and further cause the polarity of common signal to be inverted in synchronization with the inversion of polarity of moving image data.

When switching from a typical display to a still image display, the control circuit 140 assigns as write frames initial two frames that follow completion of the switching operation and sequentially writes the same still image data to the digital memory 18 during the two frames. Specifically, during the two frame periods, the control circuit 140 operates to cause the potential of the scanning line 12 to become high level in order to turn the pixel switching element 14 to an on-state and further cause the potential of the memory control signal line 19*a* to become high level in order to turn the switching element 21 to an on-state. Then, the circuit 140 operates to cause the still image data supplied through the signal line 11 to be written into the digital memory 18 via the pixel switching element 14 and the switching element 21.

After the writing of the still image data, the control circuit 140 operates to cause the potential of the scanning line 12 to become low level in order to turn the pixel switching element 14 to an off-state and further turn the switching element 25 to an on-state. This allows the inverter elements 23 and 24 to be connected in a loop. As previously described, the high power voltage and the low power voltage that are latched respectively at the outputs of the inverter elements 23 and 24 come to be latched within the loop.

During still image display operation, the control circuit 140 operates to cause the potential of the memory control signal line 19*a* to become low level and the potential of the memory control signal line 19*b* to become high level, turning the switching element 21 to an off-state and the switching element 22 to an on-state, and then, causes the still image data that is latched in the digital memory 18 to be written to the pixel electrode 13 via the inverted output terminal 28 and the switching element 22. Furthermore, the control circuit 140 is operable to stop supplying a control signal and video data to the scanning line drive circuit 120 and the signal line drive circuit 130. This allows the liquid crystal display device to provide a multi-color display while consuming low power.

During still image display operation, the still image data written to the pixel electrode 13 can be latched therein as it is for a certain duration provided that the duration is short, but when the data is latched for a long duration, the DC component applied to the liquid crystal layer 16 degrades the layer. For this reason, the liquid crystal layer needs to be alternately driven even for the duration of still image display. In the embodiment, the control circuit 140 is operable to cause the potentials of the memory control signal lines 19*a* and 19*b* to alternately become high level with a frame period, alternately turning on the switching elements 21 and 22, and then, alternately outputting a high power potential and a low power potential to the pixel electrode 13 while causing the polarity of common signal to be inverted in synchronization with the frame period. Thus, a voltage is not applied to the liquid crystal layer 16 in the pixel 10 whose pixel electrode 13 and common electrode 15 have the same polarity, and a voltage is applied to the liquid crystal layer 16 in the pixel 10 whose pixel electrode and common electrode have polarities opposite each other, allowing a black display or a white display.

As described so far, according to the embodiment, the liquid crystal display device is constructed such that when a typical display is switched to a still image display, initial two frames following the completion of the switching operation are assigned as write frames to allow still image data to be written to the digital memory 18. Therefore, even when the still image data has not been sufficiently written to the digital memory 18 during the first frame, the same still image data is written to the digital memory 18 during the second frame, allowing the still image data to be written to the digital memory 18 without error.

This permits the liquid crystal display device to make the rise times of a memory control signal and a common signal longer than a vertical blanking period in order to achieve a further decrease in power consumption during still image display operation while preventing an increase in power consumption during typical display operation, which increase is observed when the vertical blanking period is made long, the typical display period becomes short and the clock frequency during the typical display operation becomes high.

It should be appreciated that in the embodiment, although initial two frames following the completion of the switching to a still image display are assigned as write frames to allow the still image data to be written, the initial three or more frames may be assigned as write frames.

Moreover, when the pixel electrode 13 is formed of a thin and light reflecting metal, the liquid crystal display device does not need a backlight and therefore is able to drive the pixel electrode while consuming further lower power as compared to a light permeating liquid crystal display device that employs a backlight. In practice, when the liquid crystal display device displays a still image at a frame frequency of 60 Hz through its liquid crystal display panel having a diagonal of 5 cm and 2,500,000 pixels, the device operates consuming 1.3 mW in total of electrical power. Furthermore, when the device performs the writing of still image data over two frames and simultaneously increases output impedance of the signal generation circuit and reduces the current in order to make the rise times of a memory control signal and a common signal long, the device operates consuming 0.5 mW in total of electrical power without causing an erroneous writing of still image data during still image display operation.

Additionally, although the embodiment is explained as an example of a liquid crystal display device to which the invention is applied, the invention can be applied to a flat panel display device incorporating therein a display layer other than a liquid crystal layer. For example, the invention can be applied to a flat panel display device configured to have an organic electro luminescence (EL) formed on an electrode substrate and also to a flat panel display device configured to have an organic EL sandwiched between two electrode substrates that are disposed facing each other.

What is claimed is:

1. A flat panel display device comprising:

an array substrate including:

a plurality of scanning lines and a plurality of signal lines crossing each other to form a cross-wired matrix;

a pixel electrode provided so as to correspond to each lattice in the matrix;

a pixel-switching element that allows moving image data supplied to the signal line to be written to the pixel electrode in response to a scanning signal supplied to the scanning line;

a digital memory which latches still image data; and a switch circuit that inverts a polarity of still image data and retrieves the still image data from the digital memory;

an opposing substrate having a common electrode being disposed facing the pixel electrode;

a display layer held between the array substrate and the opposing substrate; and a control circuit configured to allow moving image data to be written to the pixel electrode during typical display operation and at the time of switching from a typical display to a still image display, assign as write frames at least initial two frames following the completion of the switching in order to allow still image data to be written to the digital memory, and further, to allow still image data latched in the digital memory to be written to the pixel electrode during still image display operation, wherein the device is further constructed such that at least one of the rise times of a memory control signal supplied to the switch circuit and a common signal supplied to the common electrode is made longer than a vertical blanking period immediately following the completion of the typical display.

2. The flat panel display device according to claim 1, wherein the switch circuit includes two switching elements therein and wherein during still image display operation, the control circuit is operable to make the two switching elements turned on alternately within a frame period to invert the polarity of still image data alternately and further cause a polarity of the common electrode to become opposite to the polarity of still image data.

3. A method for driving a flat panel display device, the flat panel display device comprising:

an array substrate including:

a pixel electrode provided so as to correspond to each lattice in a cross-wired matrix formed by crossing a plurality of scanning lines and a plurality of signal lines each other;

a pixel-switching element that allows moving image data supplied to the signal line to be written to the pixel electrode in response to a scanning signal supplied to the scanning line;

a digital memory which latches still image data; and a switch circuit that inverts a polarity of still image data and retrieves the still image data from the digital memory;

an opposing substrate having a common electrode being disposed facing the pixel electrode; and a display layer held between the array substrate and the opposing substrate, the method for driving the flat panel display device, comprising:

writing moving image data to the pixel electrode during typical display operation;

assigning as write frames at least initial two frames following the completion of switching from a typical display to a still image display, in order to allow still image data to be written to the digital memory;

writing still image data latched in the digital memory to the pixel electrode during still image display operation; and making at least one of the rise times of a memory control signal supplied to the switch circuit and a common signal supplied to the common electrode longer than a vertical blanking period immediately following the completion of the typical display.

4. The method for driving a flat panel display device according to claim 3, wherein during still image display operation, two switching elements constituting the switch circuit are alternately turned on within a frame period to invert the polarity of still image data alternately and further a polarity of the common electrode is made to become opposite to the polarity of still image data.

* * * * *